US007340933B2

(12) United States Patent
Stewart

(10) Patent No.: US 7,340,933 B2
(45) Date of Patent: Mar. 11, 2008

(54) STRETCH FORMING METHOD FOR A SHEET METAL SKIN SEGMENT HAVING COMPOUND CURVATURES

(75) Inventor: John R. Stewart, Jamul, CA (US)

(73) Assignee: Rohr, Inc., Chula Vista, CA (US)

( * ) Notice: Subject to any disclaimer, the term of this patent is extended or adjusted under 35 U.S.C. 154(b) by 53 days.

(21) Appl. No.: 11/276,181

(22) Filed: Feb. 16, 2006

(65) Prior Publication Data

US 2007/0186612 A1 Aug. 16, 2007

(51) Int. Cl.
*B21D 11/02* (2006.01)

(52) U.S. Cl. ..... 72/296; 72/466.2

(58) Field of Classification Search ..... 72/296, 72/295, 301, 302, 466, 466.2
See application file for complete search history.

(56) References Cited

U.S. PATENT DOCUMENTS

| | | | | |
|---|---|---|---|---|
| 1,968,010 | A * | 7/1934 | Bailey | 72/296 |
| 2,693,637 | A * | 11/1954 | Peabody et al. | 72/296 |
| 2,696,241 | A * | 12/1954 | Larsen | 72/297 |
| 2,729,265 | A * | 1/1956 | Jones | 72/466 |
| 2,868,264 | A * | 1/1959 | Jones | 72/296 |
| 4,329,862 | A | 5/1982 | Harburn et al. | |
| 4,561,613 | A | 12/1985 | Weisend, Jr. | |
| 4,608,849 | A | 9/1986 | Brugman | |
| 4,704,886 | A | 11/1987 | Evert et al. | |
| 4,743,740 | A | 5/1988 | Adee | |
| 4,837,618 | A | 6/1989 | Hatori et al. | |
| 4,942,078 | A | 7/1990 | Newman et al. | |
| 4,972,197 | A | 11/1990 | McCauley et al. | |
| 5,035,133 | A | 7/1991 | White et al. | |
| 5,323,631 | A | 6/1994 | Weykamp et al. | |
| 5,327,765 | A | 7/1994 | Weykamp et al. | |
| 5,344,696 | A | 9/1994 | Hastings et al. | |
| 5,349,839 | A | 9/1994 | Weykamp et al. | |
| 5,351,517 | A | 10/1994 | Spath | |

(Continued)

OTHER PUBLICATIONS

Andrew Parris, Precision Stretch Forming of Metal for Precision Assembly, Thesis, May 1996, Massachusetts Institute of Technology.

(Continued)

*Primary Examiner*—Daniel C Crane
(74) *Attorney, Agent, or Firm*—Jack B. Hicks; Womble Carlyle Sandridge & Rice, PLLC

(57) ABSTRACT

A method of forming an aircraft nacelle nose lip segment. The method includes bending a sheet of metal into a substantially U-shaped workpiece having a spanwise axis, opposed first and second ends, and opposed first and second edges. The method further includes placing the workpiece over a substantially flexible first mandrel, stretching the workpiece in a spanwise direction between the first and second ends, and wrapping the workpiece and first mandrel together about a curved die while stretching the workpiece. The workpiece is thereby plastically deformed to have a first shape. The method may further include removing the workpiece from the first mandrel, and placing the workpiece over a substantially rigid second mandrel that substantially corresponds in shape to the first shape of the workpiece. The workpiece is stretched over the second mandrel in a chordwise direction that is substantially transverse to the spanwise axis of the workpiece, thereby further plastically deforming the workpiece.

23 Claims, 9 Drawing Sheets

U.S. PATENT DOCUMENTS

| | | | | |
|---|---|---|---|---|
| 5,361,183 | A | | 11/1994 | Wiese |
| 5,735,160 | A | | 4/1998 | VanSumeren et al. |
| 5,771,730 | A | * | 6/1998 | Huet ..... 72/58 |
| 5,778,719 | A | * | 7/1998 | Takao ..... 72/296 |
| 5,824,996 | A | | 10/1998 | Kochman et al. |
| 5,925,275 | A | | 7/1999 | Lawson et al. |
| 5,934,617 | A | | 8/1999 | Rutherford |
| 5,942,140 | A | | 8/1999 | Miller et al. |
| 5,947,418 | A | | 9/1999 | Bessiere et al. |
| 5,971,323 | A | | 10/1999 | Rauch et al. |
| 6,018,970 | A | | 2/2000 | Ford et al. |
| 6,031,214 | A | | 2/2000 | Bost et al. |
| 6,137,083 | A | | 10/2000 | Bost et al. |
| 6,145,787 | A | | 11/2000 | Rolls |
| 6,194,685 | B1 | | 2/2001 | Rutherford |
| 6,330,986 | B1 | | 12/2001 | Rutherford et al. |
| 6,338,455 | B1 | | 1/2002 | Rauch et al. |
| 6,403,935 | B2 | | 6/2002 | Kochman et al. |
| 6,483,087 | B2 | | 11/2002 | Gardner et al. |
| 6,521,873 | B1 | | 2/2003 | Cheng et al. |
| 6,742,371 | B2 | | 6/2004 | Chancerelle |
| 6,870,139 | B2 | | 3/2005 | Petrenko |
| 7,034,257 | B2 | | 4/2006 | Petrenko |
| 2002/0062675 | A1 | | 5/2002 | Naaktgeboren et al. |
| 2002/0096506 | A1 | | 7/2002 | Moreland et al. |
| 2003/0222077 | A1 | | 12/2003 | Suda et al. |
| 2003/0234248 | A1 | | 12/2003 | Kano et al. |
| 2004/0065659 | A1 | | 4/2004 | Tse |
| 2004/0069772 | A1 | | 4/2004 | Kondo et al. |
| 2004/0074899 | A1 | | 4/2004 | Mariner et al. |
| 2005/0006529 | A1 | | 1/2005 | Moe et al. |
| 2005/0189345 | A1 | | 9/2005 | Brunner et al. |
| 2006/0032983 | A1 | | 2/2006 | Brand et al. |

OTHER PUBLICATIONS

R.E. Evans, D.E. Hall and B.A. Luxon, Nickel Coated Graphite Fiber Conductive Composites, SAMPE Quarterly, vol. 17, No. 4, Jul. 1986.

* cited by examiner

STRETCH FORMING METHOD FOR A SHEET METAL SKIN SEGMENT HAVING COMPOUND CURVATURES

FIELD OF THE INVENTION

The invention relates to methods of producing sheet metal skins having compound curvilinear shapes and large depth-to-diameter ratios, and more particularly relates to a method of stretch forming a segment of an aircraft engine nacelle inlet nose lip.

BACKGROUND

Aircraft engine nacelles provide streamlined enclosures for aircraft engines. The nacelles typically include an underlying support structure covered by a thin, aerodynamically shaped metal skin. The portion of the nacelle that surrounds an engine's inlet commonly is referred to as the nacelle inlet nose lip, or simply the noselip. The noselip has a complex shape with compound curvatures. First, the noselip has a chordwise curvature that curves from forward portions of the noselip toward aft portions of the noselip, thereby forming an aerodynamic shape. In addition, the noselip has a spanwise curvature that curves in a circumferential direction around the inlet. The noselip has a relatively large depth-to-diameter ratio. For example, the noselip may have a depth-to-diameter ratio of between about 1.0 and about 5.0. The compound curved shape of the noselip, the noselip's large depth-to-diameter ratio, and the large overall diameter of a noselip for high bypass ratio aircraft engines (up to 10 feet in diameter) can make the noselip particularly difficult to manufacture. Noselips commonly are produced in multiple arcuate segments to facilitate their manufacture and maintainability. The arcuate segments are assembled together in a conventional manner known to those skilled in the art to form a complete noselip.

Draw forming is one traditional method used to produce a sheet metal skin segment having a complex, multi-curved shape, and a large depth-to-diameter ratio. The draw forming process plastically deforms a sheet of metal by fixing the edges of the metal, and plunging a specially constructed die or punch into the sheet. The die has a shape corresponding to the desired shape of the formed metal. Optionally, the sheet of metal may be preheated before forming. The deep drawing process often requires multiple drawing cycles to produce a finally formed part. Unfortunately, the draw forming process is complex and time consuming. In addition, the draw dies used in the draw forming process experience substantial wear, and require periodic refurbishment or replacement. Furthermore, the tooling and equipment required to draw form a nacelle noselip, for example, can be expensive to purchase and costly to maintain.

Another common method of forming a complex skin segment having a large depth-to-diameter ratio is spin forming. Spin forming involves spinning a thin-walled workpiece on a rotating mandrel while heating and deforming the workpiece. Spin forming permits formation of a complete nacelle noselip in a single piece. The spin formed workpiece can be finally shaped during spin forming, or can be preformed by spin forming and finally shaped on a drop hammer die or the like. Unfortunately, the equipment and tooling required to spin form a part as large as a nacelle noselip can be expensive to purchase, and costly to maintain.

Thus, there is a need for an alternative, less costly, and less time-consuming process for producing metal skins having complex shapes and large depth-to-diameter ratios, such as nacelle inlet noselips.

SUMMARY OF THE INVENTION

The invention includes a stretch-forming process for producing a thin metal skin having multiple axes of curvature. The method includes forming a sheet of metal into a curved channel having a longitudinal first axis. The method further includes plastically stretching the channel in a longitudinal direction while substantially simultaneously bending the channel about a second axis. The method can further include plastically stretching the channel in a direction that is substantially transverse to the longitudinal axis.

The invention also includes a method of forming a sheet metal skin having compound curvatures. The method includes bending a sheet of metal about a first mandrel having a longitudinal axis to form a channel. The method further includes plastically stretching the channel in a longitudinal direction while substantially simultaneously bending the channel and first mandrel about a curved second mandrel, wherein the second mandrel has an axis of curvature that is non-parallel to the longitudinal axis of the first mandrel.

The invention further includes a method of forming an aircraft nacelle nose lip segment. The method includes bending a sheet of metal into a substantially U-shaped workpiece having a longitudinal axis, opposed first and second ends, and opposed first and second edges. The method also includes placing the workpiece over a substantially flexible first mandrel, longitudinally stretching the workpiece between the first and second ends, and wrapping the workpiece and first mandrel together about a curved die while longitudinally stretching the workpiece, whereby the workpiece is plastically deformed to have a first shape. The method further includes removing the workpiece from the first mandrel, placing the workpiece over a substantially rigid second mandrel that substantially corresponds in shape to the first shape of the workpiece, and stretching the workpiece over the second mandrel between the first and second edges in a direction that is substantially transverse to the longitudinal axis of the workpiece. Accordingly, the workpiece is further plastically deformed to have a second shape.

These and other aspects of the invention will be understood from a reading of the following detailed description together with the drawings.

DETAILED DESCRIPTION

Figure 1:
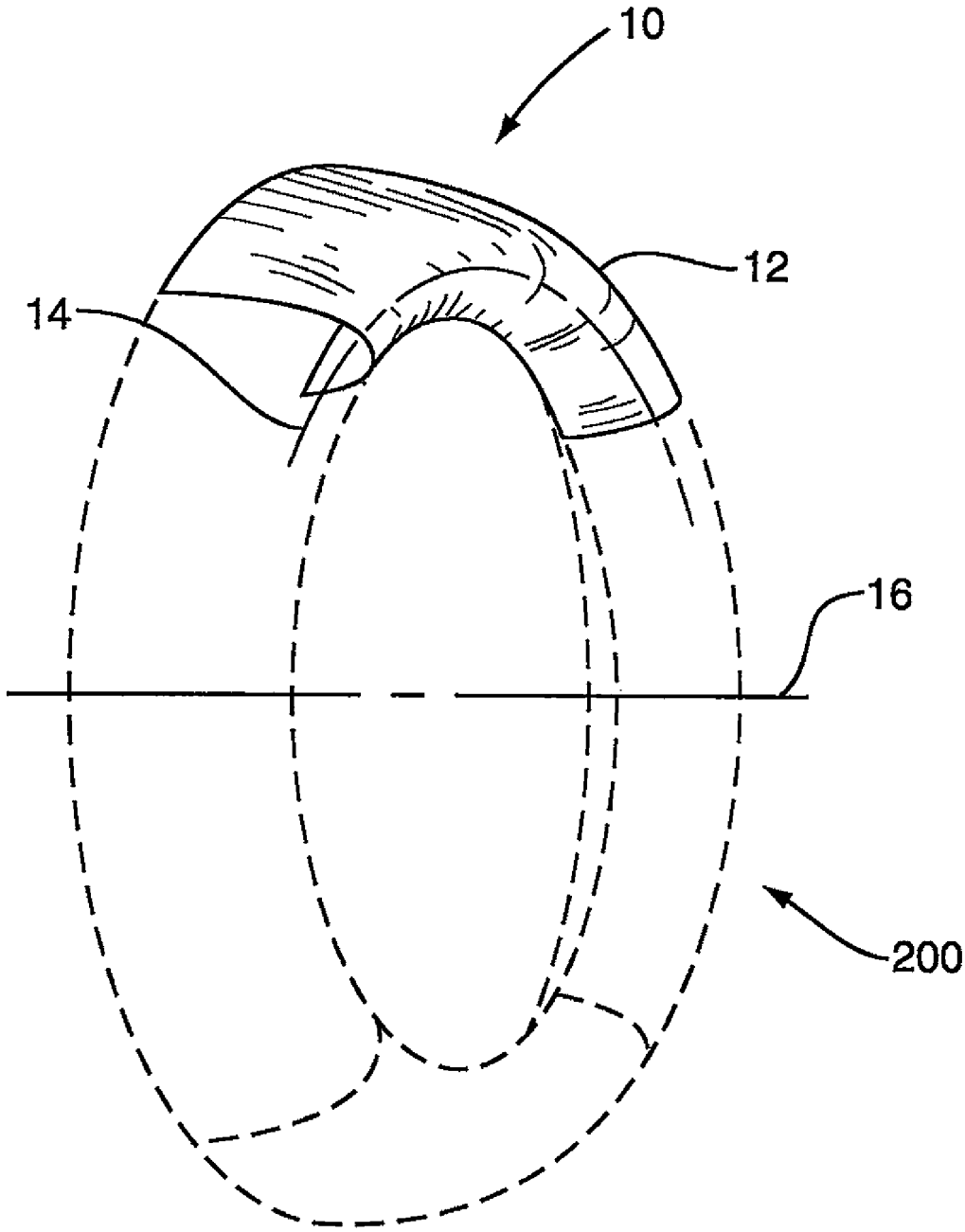
FIG. 1 is a perspective view of a nacelle inlet noselip segment produced by a method according to the invention.

FIG. 1 shows a nacelle inlet noselip segment 10 produced by a method according to the invention. The noselip segment 10 forms a portion of a complete noselip 200 indicated in dashed lines. As shown in FIG. 1, the noselip 200 and noselip segment 10 includes a spanwise axis 14 about which the noselip curves in a chordwise direction. In addition, the noselip 200 and noselip segment 10 includes a chordwise central axis 16, about which the noselip curves in a spanwise direction. As used herein, a "chordwise axis" extends between a forward (or leading edge) position and an aft (or trailing edge) position, or extends substantially parallel to a forward-aft direction. In addition, as used herein, a "spanwise axis" extends in a direction that is substantially perpendicular to a chordwise axis, and extends along or parallel to the span of an elongated structure, or along or parallel to the circumference of a circular or semi-circular structure. In addition, as used herein, "chordwise" describes a direction or orientation that is substantially parallel to a chordwise axis, and "spanwise" describes a direction or orientation that is substantially parallel to a spanwise axis. In FIG. 1, the chordwise axis 16 substantially coincides with a central longitudinal axis of an associated aircraft engine, and the center of the engine's inlet.

Figure 2:
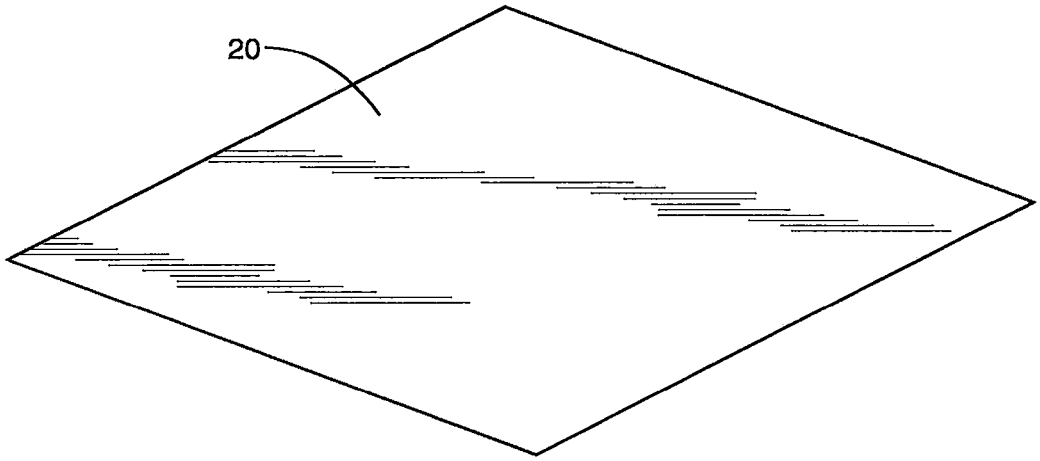
FIG. 2 is a perspective view of a substantially flat sheet of metal used to form the noselip of FIG. 1.

FIG. 2 shows a substantially flat, thin-gauge metal sheet 20 from which the noselip 10 can be formed according to the invention. In one embodiment, the sheet metal 20 is bare aluminum 2219 sheet having an initial nominal thickness from about 0.080 inch to about 0.125 inch. Other types, grades, and thickness of substantially ductile sheet metal also may be used. For example, a noselip 10 can be formed by a process according to the invention from a substantially ductile metal sheet of aerospace grade aluminum or titanium alloy having a nominal thickness between about 0.008 inch and about 0.250 inch.

Figure 3:
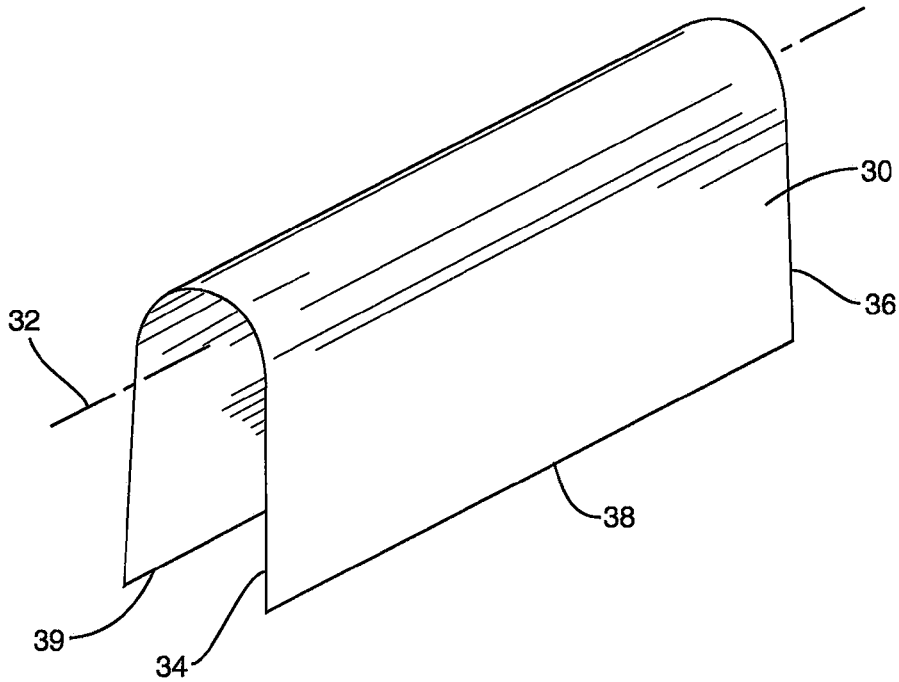
FIG. 3 is a substantially U-shaped workpiece formed from the substantially flat sheet of metal shown in FIG. 2.

In a process according to the invention, the metal sheet 20 can be plastically bent into a substantially U-shaped channel or workpiece 30 as shown in FIG. 3. The U-shaped workpiece 30 has a spanwise or longitudinal axis 32, opposed ends 34, 36, and opposed edges 38, 39. The metal sheet 20 can be bent to form the U-shaped workpiece 30 by any suitable or desired bending process.

Figure 4:
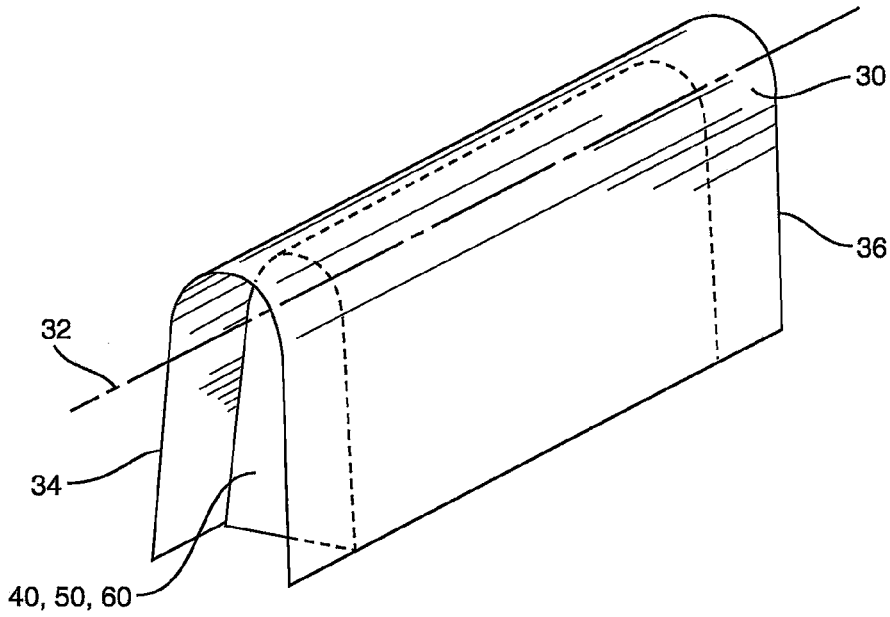
FIG. 4 is a perspective view of the U-shaped workpiece of FIG. 3 positioned on the flexible pre-form mandrel shown in FIG. 5, FIG. 6, or FIGS. 7A and 7B.
Figure 5:
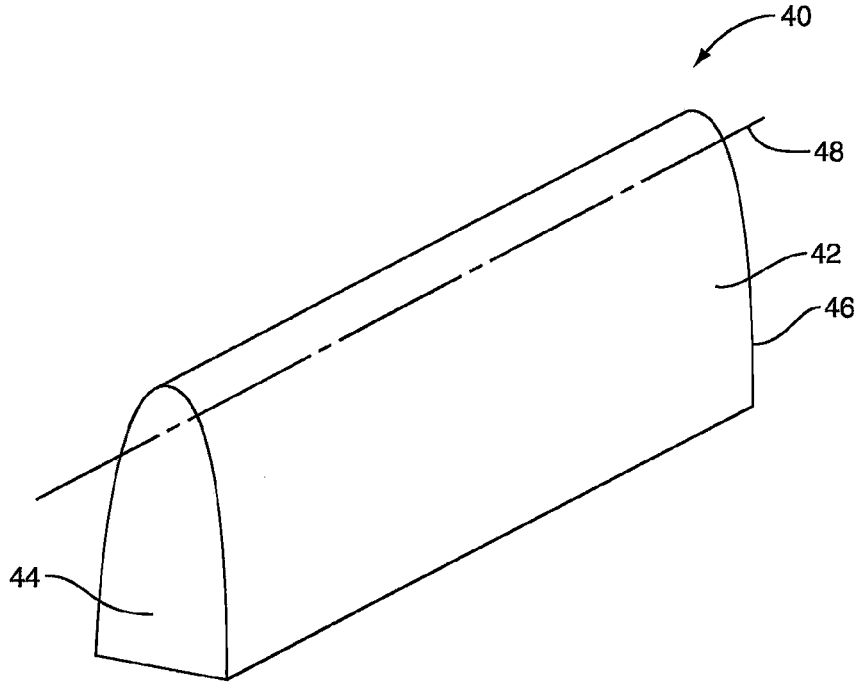
FIG. 5 is a perspective view of a one-piece flexible pre-form mandrel for use in pre-forming the workpiece shown in FIG. 3.
Figure 6:
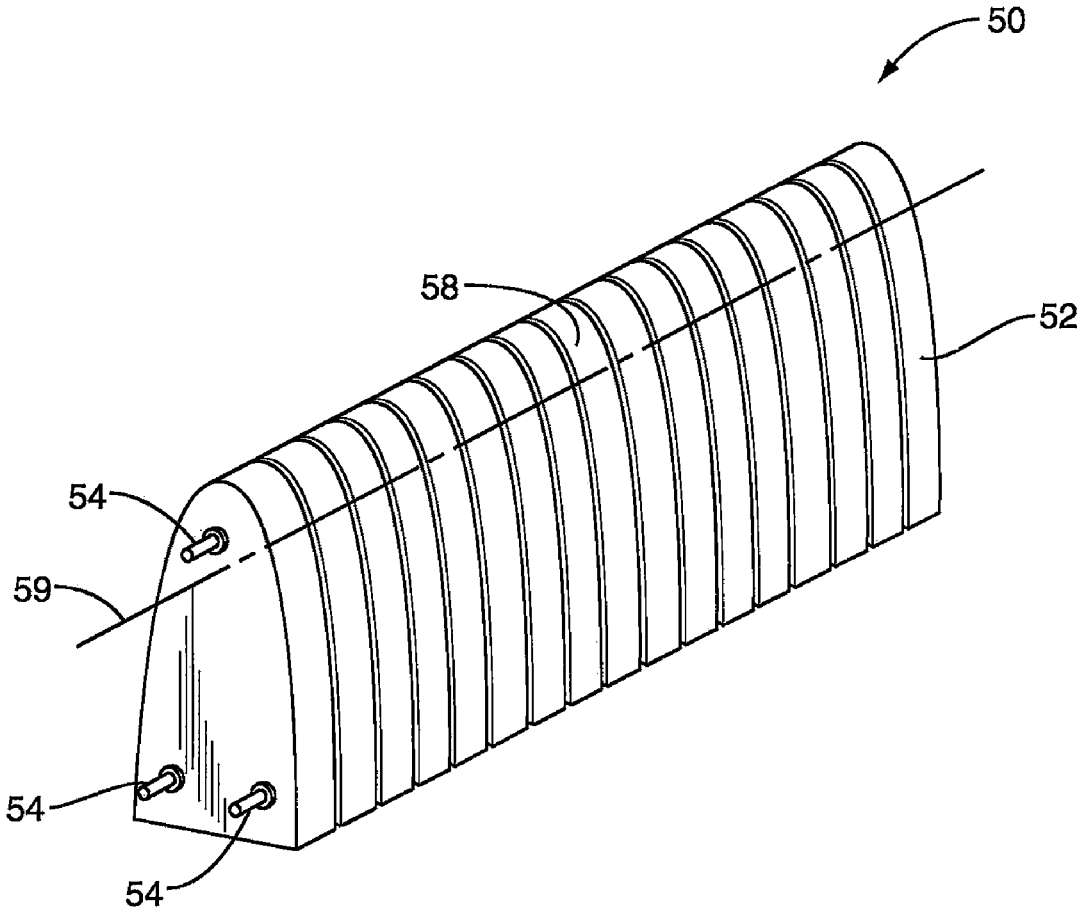
FIG. 6 is a perspective view of segmented flexible pre-form mandrel for use in preforming the workpiece shown in FIG. 3.

The U-shaped workpiece 30 is placed over a flexible pre-form mandrel 40, 50, 60 as shown in FIG. 4. As used herein, the terms "flexible" and "bendable" are used interchangeably to mean being capable of flexing or bending in at least one direction without substantial permanent deformation or breakage. Various embodiments 40, 50, 60 of the flexible pre-form mandrel are shown in FIGS. 5-7. As shown in FIG. 5, a first embodiment of the flexible pre-form mandrel 40 is an elongated member having a curved upper surface 42 and substantially flat ends 44, 46. The curved upper surface 42 curves about a spanwise or longitudinal axis 48. The curvature of the upper surface substantially corresponds to the desired chordwise curvature of a finally formed nacelle noselip 10. The pre-form mandrel 40 preferably is constructed of a flexible and substantially incompressible material. As used herein, the term "incompressible" is used to refer to a material that substantially maintains its original thickness when subjected to compressive forces experienced during the stretch forming process described herein. In a preferred embodiment, the pre-form mandrel is constructed of a polymeric material, such as polyurethane, having sufficient hardness to be substantially incompressible, and being sufficiently ductile to permit sufficient flexing and bending during the stretch forming process described herein. In a preferred embodiment, the pre-form mandrel is constructed of polyurethane having a Shore A hardness of about 65.

A second embodiment 50 of a pre-form mandrel for use in a process according to the invention is shown in FIG. 6. In this embodiment, the pre-form mandrel 50 includes a plurality of articulating segments 52. The segments 52 can be flexibly interconnected by any suitable connection means. For example, the segments 52 can be interconnected by one or more wire cables 54, links, hooks, hinges, or the like. When interconnected, the segments 52 are capable of at least partially rotating relative to each other. Accordingly, the mandrel 50 is capable of being articulated into a bent shape. Like mandrel 40 described above, the articulated mandrel 50 has a spanwise or longitudinal axis 59, and a curved upper surface 58 that substantially corresponds to a desired chordwise curvature of a finally formed nacelle noselip 10. The segments 52 may be constructed of any suitable substantially incompressible material. For example, the segments 52 may be constructed of polyurethane or another suitable plastic material, metal, wood, concrete, or the like.

Figure 7A:
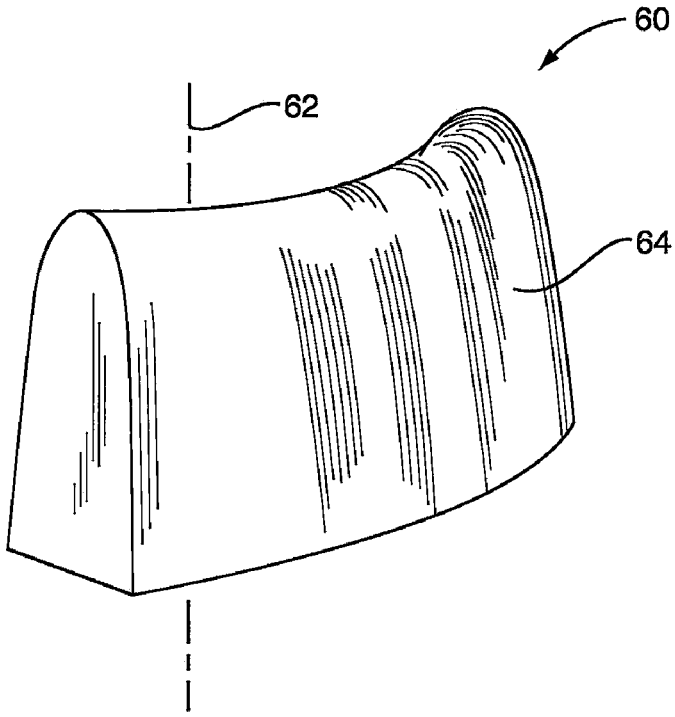
FIG. 7A is a perspective view of a curved one-piece flexible pre-form mandrel in an unrestrained state for use in pre-forming the workpiece shown in FIG. 3.
Figure 7B:
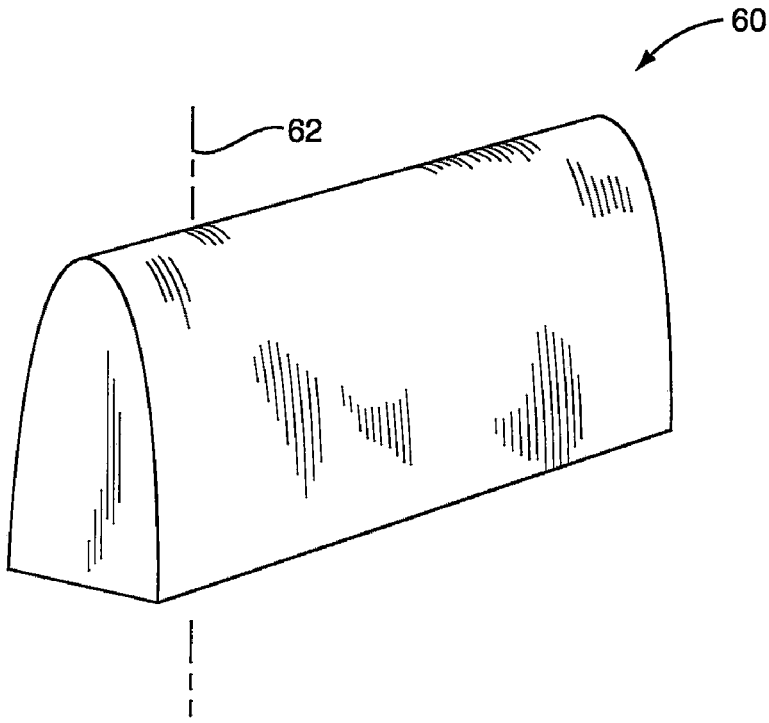
FIG. 7B is a perspective view of the flexible perform mandrel of FIG. 7A in a restrained, non-curved state.

A third embodiment of a pre-form mandrel for use in a process according to the invention is shown in FIGS. 7A and 7B. As shown in an unrestrained state in FIG. 7A, the pre-form mandrel 60 is similar to the non-segmented mandrel 40 described above, but has a spanwise curvature around a chordwise axis 62. In the unrestrained state shown in FIG. 7A, the upper surface 64 of the pre-form mandrel 60 substantially corresponds in shape to a finally formed nacelle noselip 10, like that shown in FIG. 1. The mandrel 60 is constructed of a flexible and substantially incompressible material such as polyurethane. The flexible material permits the mandrel 60 to be restrained in a straightened condition (like that shown in FIG. 7B). In this restrained condition, the mandrel 60 is substantially identical in shape to the non-segmented mandrel 40 described above.

Figure 9:
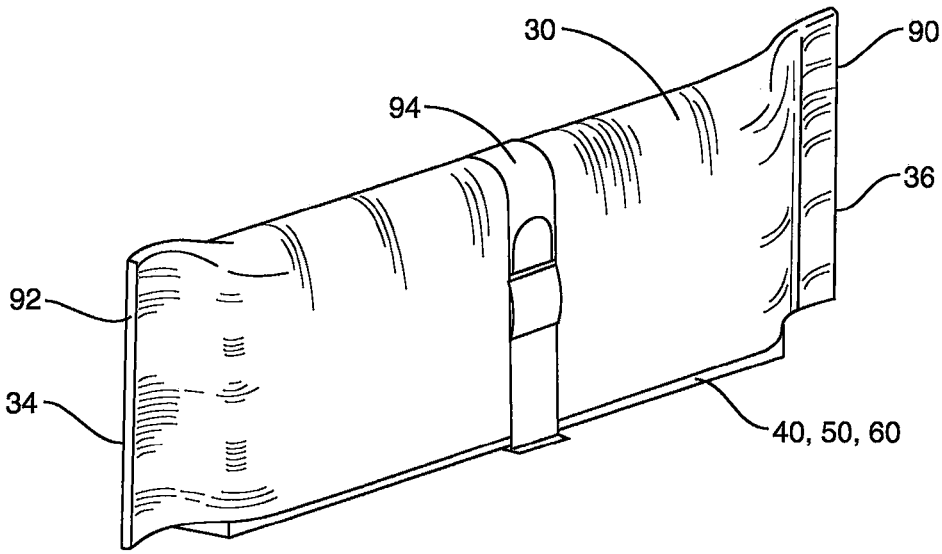
FIG. 9 is a perspective view similar to that of FIG. 4, and showing each end of the U-shaped workpiece crimped to form opposed gripping portions.

As shown in FIG. 9, in a preferred embodiment of a process according to the invention, the ends 34, 36 of the workpiece 30 are crimped to form substantially flat gripping portions 90, 92. The gripping portions 90, 92 facilitate gripping the ends 34, 36 of the workpiece 30 during the pre-form stretching of the workpiece 30 described in detail below. Spacer blocks may be placed near the ends of the U-shaped workpiece 30 as the ends 34, 36 are crimped to maintain the general shape of the workpiece 30 adjacent to the gripping portions 90, 92 (not shown). Alternatively, the ends 34, 36 can be left uncrimped as shown in FIG. 4.

Figure 8:
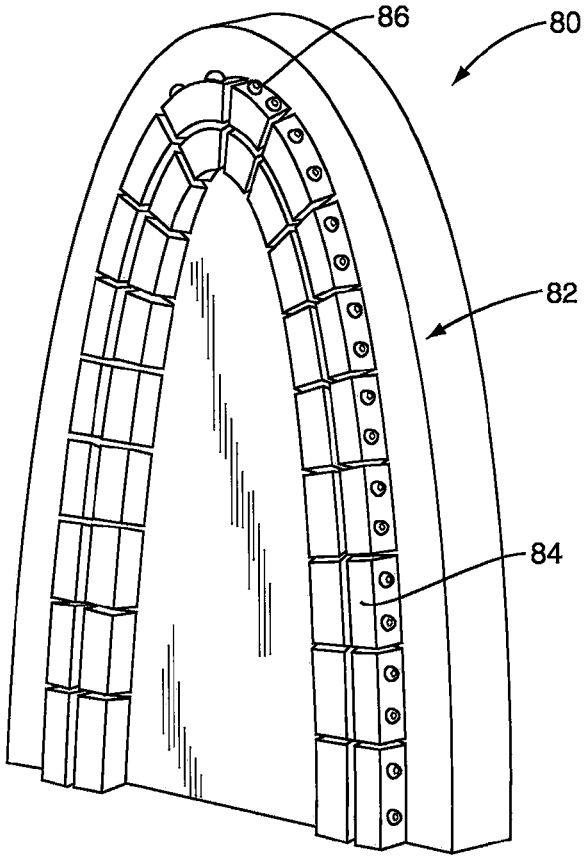
FIG. 8 is a perspective view of an end-gripping jaw for gripping and longitudinally stretching the U-shaped workpiece on the flexible pre-form mandrel shown in FIG. 4.

In an alternative embodiment, the ends 34, 36 of the workpiece 30 are left uncrimped. In this embodiment, gripping fixtures or jaws 80 like that shown in FIG. 8 may be used to grip the U-shaped ends 34, 36 of the workpiece 30 during the pre-form stretching of the workpiece 30 that is described in detail below. Each jaw 80 includes a plurality of pairs of blocks 84 arranged in a generally U-shaped pattern on a base 82. Each pair of blocks 84 is configured to receive a portion of an end 34, 36 of the workpiece 30 between the pair of blocks 84. Each pair of blocks 84 is compressed together using threaded fasteners 86 or the like to grippingly engage a corresponding portion of an end 34, 36 of the workpiece 30. The opposite side of the base 82 of each jaw 80 is provided with one or more suitable attachment elements for connection to a stretch-forming device (not shown).

As shown in FIG. 9, the workpiece 30 is placed over the flexible pre-form mandrel 40, 50, or 60. One or more anchor straps 94 or similar restraining devices may be used to maintain contact between the work-piece 30 and mandrel 40, 50, or 60 during pre-form stretching.

Figure 10A:
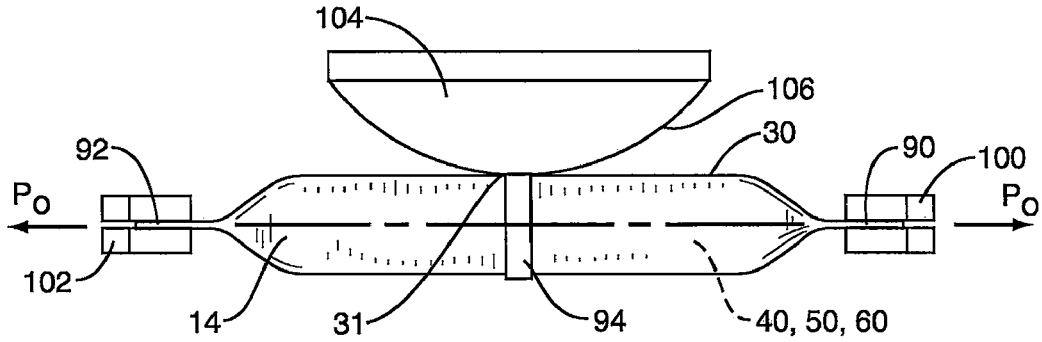
FIG. 10A is a plan view showing an arrangement for initial stretch forming of the U-shaped workpiece on the flexible pre-form mandrel.
Figure 10B:
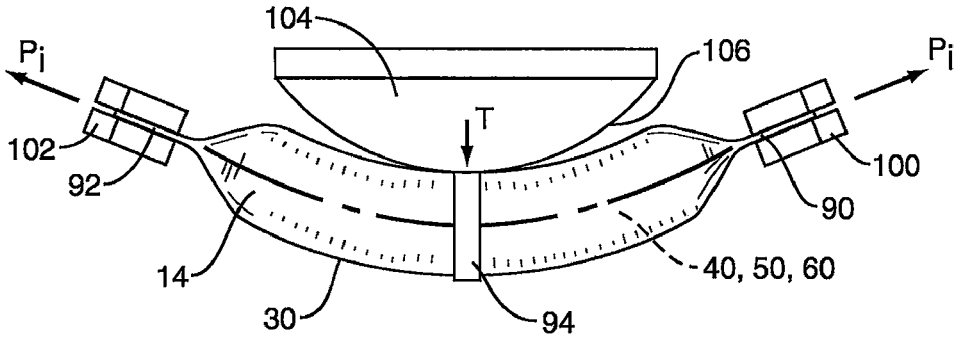
FIG. 10B is a plan view showing the U-shaped workpiece being partially stretched on the pre-form mandrel and partially wrapped around the curved die.
Figure 10C:
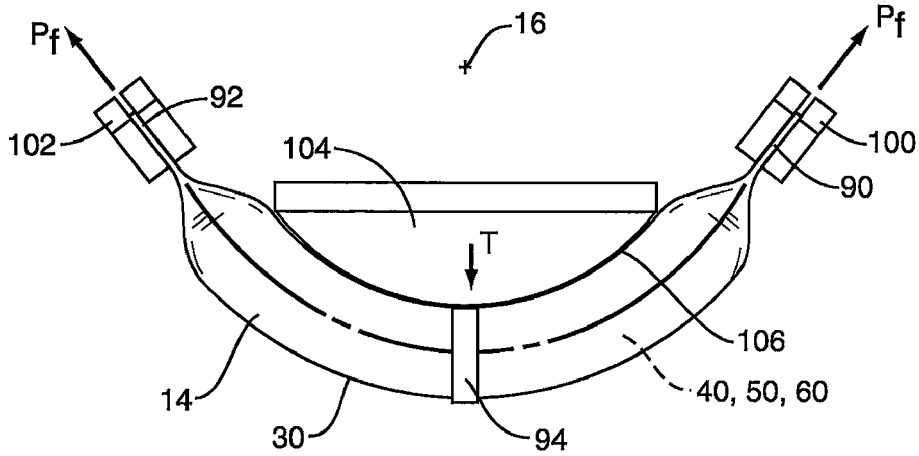
FIG. 10C is a plan view showing the U-shaped workpiece being finally stretched on the pre-form mandrel and finally wrapped around the curved die.

One embodiment of a pre-form stretching portion of a process according to the invention is shown in FIGS. 10A-10C. As shown in FIG. 10A, a curved die 104 is positioned adjacent to an inside surface of the workpiece 30. The curved die 104 has a curved surface 106 that is substantially centered along an inside surface of the workpiece 30. The curved die 104 may be constructed of any suitable material. For example, the curved portion of the die 104 may be constructed of polyurethane or another suitable plastic material, metal, wood, concrete, or the like. In the embodiment shown in FIGS. 10A-10C, the workpiece 3 has crimped gripping portions 90, 92 as described above. Opposed articulating jaws 100, 102 tightly grip the gripping portions 90, 92. The articulating jaws 100, 102 are configured to withstand a tensile force "P" in a direction that is substantially coincident with the spanwise axis 14 of the workpiece 30 as the workpiece is stretch formed. The jaws 100, 102 preferably are connected to articulating hydraulic cylinders (not shown) as are common in known skin press machines. The hydraulic cylinders permit monitoring of the tensile force P during pre-form stretching by measurement of the cylinder pressures.

FIG. 10A shows the workpiece 30 in an initial position prior to pre-form stretching. In this beginning position, an initial pre-tension $P_O$ is applied to the workpiece 30 by articulating jaws 100, 102. FIG. 10B shows the workpiece 30 during an intermediate stage of pre-form stretching. As shown in FIG. 10B, the curved die 104 is advanced in a direction "T" against the inside surface of the workpiece 30 and the enclosed pre-form mandrel 40, 50, or 60. As the curved die 104 presses against the inside surface of the workpiece 30, the central portions of the workpiece 30 and pre-form mandrel 40, 50, 60 are displaced, and the workpiece 30 and mandrel 40, 50, 60 begin to conform to the curvature of the die 104. In addition, the workpiece 30 is stretched in a spanwise direction between the articulating jaws 100, 102. The process is continued until the workpiece is substantially fully stretched around the curved surface 106 of the die 104, and/or desired spanwise tensile forces $P_f$ are measured at the jaws 100, 102, as indicated in FIG. 10C. In one embodiment of the process, the spanwise tensile forces $P_f$ are about 30 tons at each end of the workpiece 30 when the workpiece is bare aluminum 2219 sheet having an initial nominal thickness from about 0.080 inch to about 0.125 inch. Under such conditions, the workpiece 30 undergoes substantial plastic strains in a direction parallel to its spanwise axis 14. For example, the material may undergo plastic strains between about 6 percent and about 16 percent. Accordingly, when the curved die 104 is withdrawn from the workpiece 30, the workpiece 30 substantially maintains the spanwise curvature imparted by the die 104.

Figure 11:
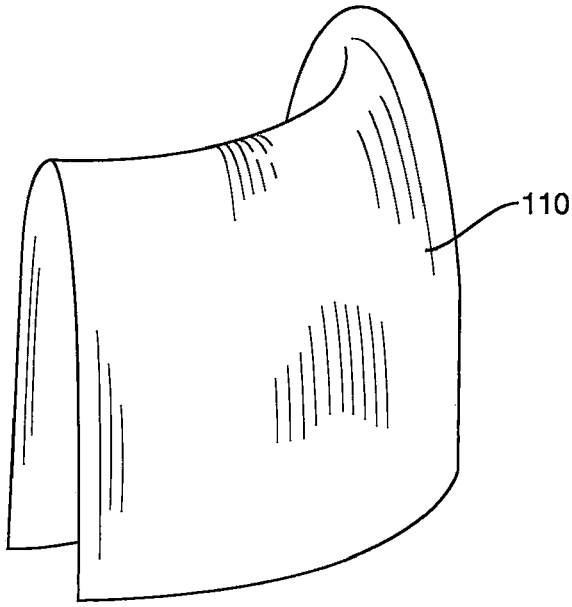
FIG. 11 is a perspective view showing the workpiece after the gripping portions have been trimed from its ends.

The workpiece 30 is removed from the flexible mandrel 40, 50, 60, and the gripping portions 90, 92 are removed to form a pre-formed workpiece 110, as shown in FIG. 11. Preferably, the workpiece 30 is thermally treated before final stretch forming (described below) to at least partially relieve stresses within the skin and to stabilize the stretch-formed shape of work-piece 30. For example, when the workpiece is fabricated from bare aluminum 2219 sheet having an initial nominal thickness from about 0.080 inch to about 0.125 inch, the workpiece maybe heat treated at about 995 degrees F. for about 40 minutes.

Figure 12:
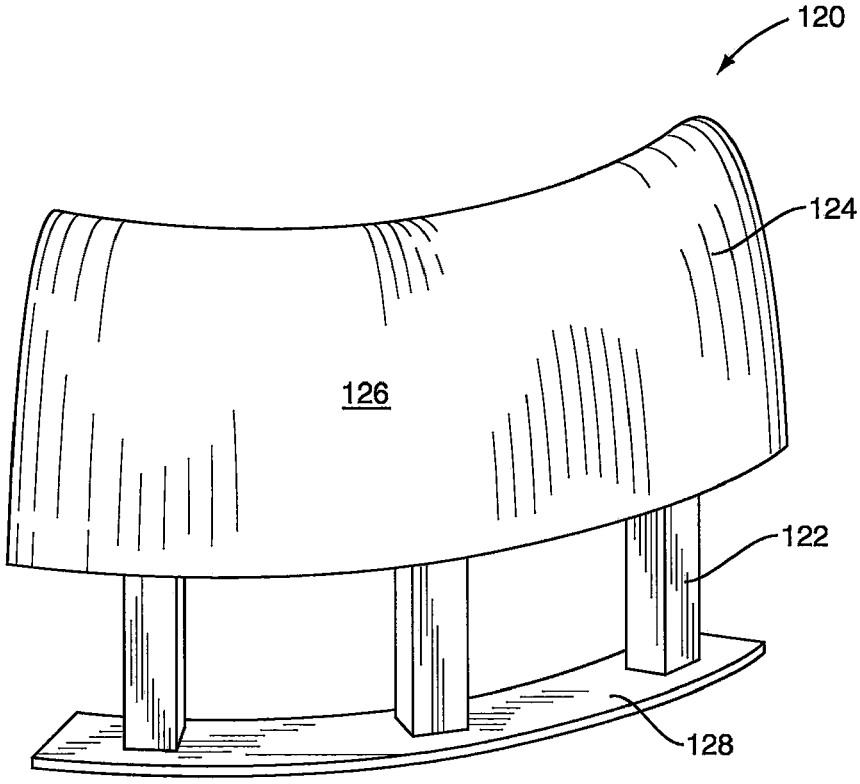
FIG. 12 is a perspective view showing a finish-form mandrel for use in finally stretch forming the workpiece.
Figure 13:
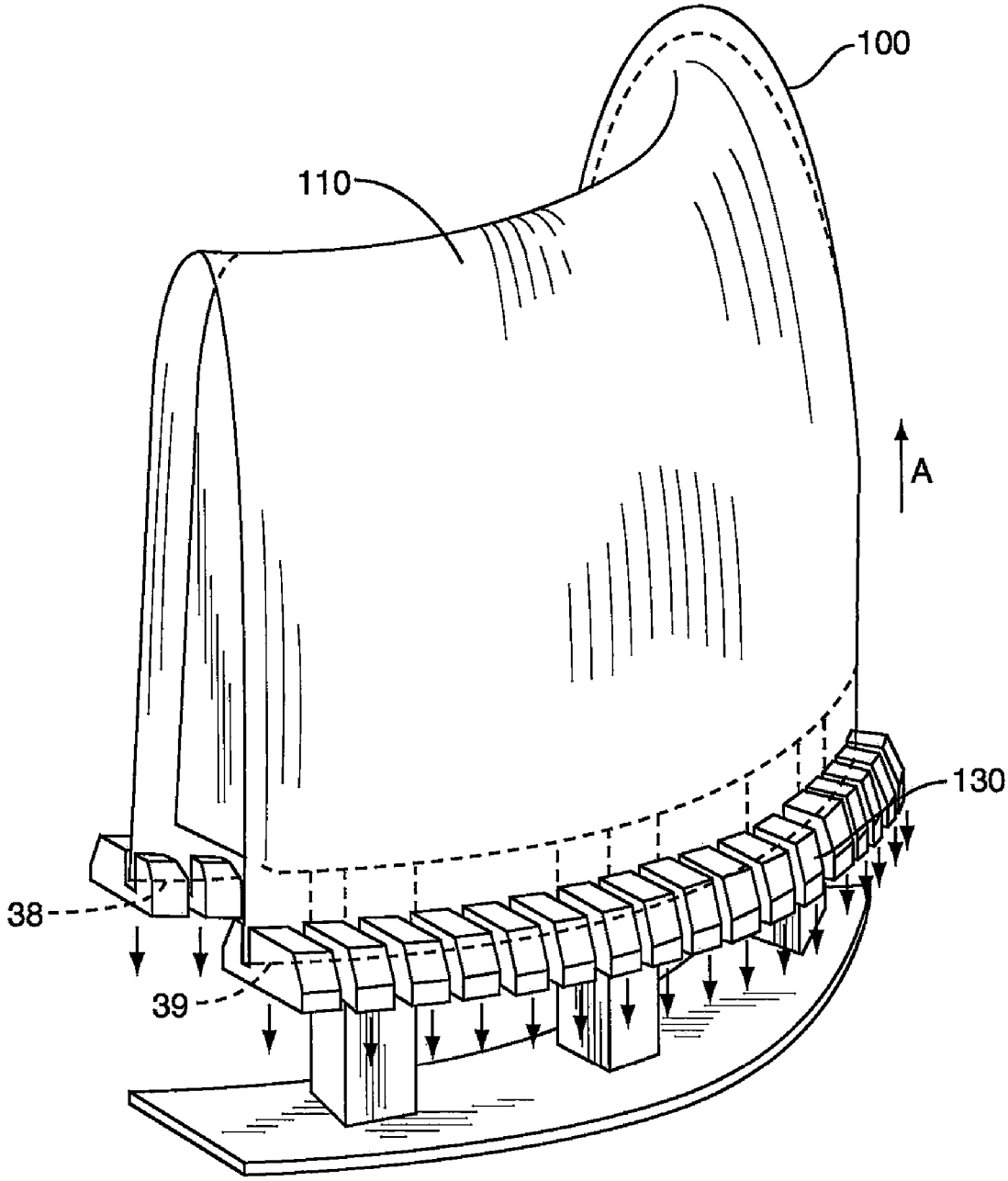
FIG. 13 is a perspective view showing the workpiece positioned on the finish-form mandrel of FIG. 12, and showing the workpiece being stretched in a chordwise direction over the finish-form mandrel.

As shown in FIG. 13, the pre-formed workpiece 110 is placed over a finish-form mandrel 120. As shown in FIG. 12, the finish-form mandrel 120 may include a forming portion 124, a frame 122, and a base 128. The forming portion 124 includes an upper surface 126 that substantially corresponds in shape to a completed nacelle inlet noselip 10 like that shown in FIG. 1. As shown in FIG. 13, the edges 38, 39 of workpiece 110 are grippingly engaged by gripping jaws 130. The gripping jaws 130 include a plurality of vice-like blocks that tightly grip the edges 38, 39 of workpiece 110, and are fixed to a stationary foundation or structure. The final form mandrel 120 is advanced in direction "A" against the resistance of the gripping jaws 130 (indicated by downwardly extending arrows), thereby stretching the workpiece 110 in a chordwise direction over the mandrel 120. The process is continued until a sufficient degree of chordwise plastic strain is induced in the workpiece 110. For example, the skin of workpiece 110 may be stretched to produce plastic strains ranging from about 6 percent to about 16 percent in bare aluminum 2219 sheet having an initial nominal thickness from about 0.080 inch to about 0.125 inch.

The stretch forming operations described above may be performed on a conventional skin press machine. For example, the stretch forming operations may be performed on a numerically controlled sheet stretch form press, such as a Sheridan Model No. LV-300-72-22 150-ton sheet stretch press. Of course, other types of skin press or stretch forming devices, or other specially designed equipment also may be used in a process according to the invention.

After final stretch forming is completed, the jaws 130 are disengaged from the workpiece 110, and the workpiece 110 is removed from the final-form mandrel 120. Excess material is trimmed from the workpiece to a form a complete nacelle inlet noselip segment like that shown in FIG. 1. If necessary, the workpiece 110 may be hand worked or otherwise further shaped to have the desired contours of the finished noselip segment 10. The workpiece 110 may be age hardened to yield desired material properties. For example, a workpiece constructed of bare aluminum 2219 sheet having an initial nominal thickness from about 0.080 inch to about 0.125 inch may be age hardened at about 360 degrees F. for about 36 hours.

The above descriptions of various embodiments of the invention are intended to describe and illustrate various aspects of the invention. Persons of ordinary skill in the art will recognize that various changes or modifications may be made to the described embodiments without departing from the scope of the invention. For example, though the processes described above primarily have been described regarding production of a nacelle inlet noselip for an aircraft engine, persons of ordinary skill in the art will recognize that the described methods also can be used to produce other complex curved skin structures having large depth-to-diameter ratios. In addition, whereas the stretch-forming operations are described herein as including substantially stationary gripping jaws and movable forming fixtures, the stretch forming operations may be performed equally well using stationary fixtures and movable gripping jaws. All such changes and modifications are intended to be within the scope of the appended claims.

What is claimed is:

1. A method of forming an aircraft nacelle inlet noselip segment, the method comprising:

(a) shaping a sheet of metal into a substantially U-shaped workpiece having a spanwise axis, opposed first and second ends, and opposed first and second edges;

(b) placing the shaped workpiece on a substantially flexible first mandrel;

(c) stretching the workpiece in a spanwise direction between the first and second ends while bending the workpiece and first mandrel together about a die, whereby the workpiece is plastically deformed to have a first shape;

(d) removing the workpiece from the first mandrel;

(e) placing the workpiece over a substantially rigid second mandrel that substantially corresponds in shape to the first shape of the workpiece; and (f) stretching the workpiece over the second mandrel between the first and second edges in a chordwise direction that is substantially transverse to the spanwise axis of the workpiece, whereby the workpiece is further plastically deformed to have a second shape.

2. A method according to claim 1, and further comprising annealing the workpiece before placing the workpiece over the substantially rigid second mandrel and before stretching the workpiece over the second mandrel.

3. A method according to claim 1, and further comprising crimping the first end of the workpiece to form a first gripping portion, and crimping the second end of the workpiece to form a second gripping portion.

4. A method according to claim 1 and further comprising:

(a) crimping the first end to form a first gripping portion, and crimping the second end to form a second gripping portion; and (b) removing the first and second gripping portions from the workpiece before stretching the workpiece over the second mandrel.

5. A method according to claim 1, comprising stretching the workpiece over the first mandrel having a plurality of interconnected segments.

6. A method according to claim 1, comprising stretching the workpiece over a bendable and substantially incompressible first mandrel.

7. A method according to claim 1 comprising stretching the first workpiece in the spanwise direction on a skin press machine.

8. A method according to claim 1, and further comprising trimming the workpiece to a final shape.

9. A method according to claim 1, wherein:

(a) the first mandrel comprises a polymeric material;

(b) the first mandrel substantially corresponds in shape to the first shape when the first mandrel is in an unrestrained state; and (c) wherein the method further comprises reshaping the first mandrel to substantially correspond in shape to the U-shaped workpiece before placing the workpiece over the first mandrel.

10. A method according to claim 1 and further comprising age hardening the workpiece after stretching the workpiece over the second mandrel.

11. A method of forming compound curvatures in a metal sheet, the method comprising:

(a) bending the metal sheet about a first mandrel having a spanwise axis to form a channel;

(b) plastically stretching the channel in a spanwise direction while substantially simultaneously bending the channel and first mandrel about a second mandrel, the second mandrel having a curvature that is non-parallel to the spanwise axis of the first mandrel.

12. A method according to claim 11 and further comprising further plastically stretching the channel in a direction that is substantially transverse to the spanwise direction.

13. A method according to claim 11, and further comprising annealing the channel after plastically stretching the channel.

14. A method according to claim 12, and further comprising age hardening the channel after further plastically stretching the channel.

15. A method according to claim 11 wherein the first mandrel comprises a plurality of interconnected segments.

16. A method according to claim 11, wherein the first mandrel comprises a flexible polymeric material.

17. A method according to claim 11, wherein the first mandrel comprises a bendable and substantially incompressible material.

18. A method according to claim 11 wherein the spanwise stretching is performed on a skin press machine.

19. A method according to claim 12 wherein further plastically stretching the channel in a direction that is substantially transverse to the spanwise direction comprises stretching the channel about a third mandrel.

20. A stretch-forming method for producing metal skin segments having compound curvatures, the method comprising:

(a) forming a sheet of metal into a curved channel having a spanwise first axis of curvature;

(b) plastically stretching the channel in a spanwise direction while substantially simultaneously bending the channel about a second axis of curvature; and (c) plastically stretching the channel in a direction that is substantially transverse to the spanwise first axis after plastically stretching the channel in a spanwise direction.

21. A method according to claim 20, and further comprising annealing the channel after plastically stretching and bending the channel.

22. A method according to claim 20, and further comprising age hardening the channel after stretching the channel in a direction that is substantially transverse to the spanwise first axis.

23. A method according to claim 20, wherein the method yields an aircraft nacelle inlet nose lip segment.

* * * * *